US008093199B2

(12) United States Patent
Johnson et al.

(10) Patent No.: US 8,093,199 B2
(45) Date of Patent: Jan. 10, 2012

(54) PREMOISTENED CLEANING DISPOSABLE SUBSTRATE AND METHOD OF INCORPORATION OF A CLEANING COMPOSITION INTO SAID SUBSTRATE

(75) Inventors: Andress K. Johnson, High Point, NC (US); Stephen E. Minter, Greensboro, NC (US)

(73) Assignee: BASF SE, Ludwigshafen (DE)

( * ) Notice: Subject to any disclaimer, the term of this patent is extended or adjusted under 35 U.S.C. 154(b) by 24 days.

(21) Appl. No.: 11/983,310

(22) Filed: Nov. 8, 2007

(65) Prior Publication Data

US 2008/0293613 A1 Nov. 27, 2008

Related U.S. Application Data

(60) Provisional application No. 60/859,913, filed on Nov. 17, 2006.

(51) Int. Cl.
*C11D 17/04* (2006.01)
*C11D 3/37* (2006.01)
*B08B 7/00* (2006.01)

(52) U.S. Cl. ..... 510/438; 510/108; 510/181; 510/191; 510/214; 510/276; 510/278; 510/280; 510/475; 134/42

(58) Field of Classification Search ..... 510/438, 510/108, 475, 181, 191, 214, 276, 278, 280; 134/42

See application file for complete search history.

(56) References Cited

U.S. PATENT DOCUMENTS

| | | | | |
|---|---|---|---|---|
| 4,014,808 | A | 3/1977 | Herpers, Jr. et al. | 252/135 |
| 4,248,928 | A * | 2/1981 | Spadini et al. | 510/513 |
| 4,624,890 | A | 11/1986 | Lloyd et al. | 428/290 |
| 4,820,450 | A | 4/1989 | Wile et al. | 252/545 |
| 5,326,492 | A | 7/1994 | Hodam, Jr. | 252/106 |
| 5,348,678 | A | 9/1994 | Hodam, Jr. et al. | 252/106 |
| 5,368,779 | A | 11/1994 | Snethen | 252/545 |
| 5,507,968 | A | 4/1996 | Palaikis | 252/90 |
| 5,686,088 | A | 11/1997 | Mitra et al. | 424/404 |
| 5,720,961 | A * | 2/1998 | Fowler et al. | 424/401 |
| 6,251,849 | B1 | 6/2001 | Jeschke et al. | 510/470 |
| 6,653,274 | B1 | 11/2003 | Godfroid et al. | 510/499 |
| 6,716,805 | B1 | 4/2004 | Sherry et al. | 510/295 |
| 7,048,806 | B2 | 5/2006 | Ochomogo et al. | 134/34 |
| 7,049,281 | B2 | 5/2006 | Mondin et al. | 510/475 |
| 2003/0100465 | A1 * | 5/2003 | Kilkenny et al. | 510/384 |
| 2003/0216272 | A1 * | 11/2003 | Sherry et al. | 510/295 |
| 2005/0192199 | A1 | 9/2005 | Cartwright et al. | 510/420 |
| 2006/0003649 | A1 * | 1/2006 | Runge et al. | 442/59 |
| 2006/0018862 | A1 * | 1/2006 | Chen et al. | 424/70.14 |
| 2006/0052269 | A1 | 3/2006 | Panandiker et al. | 510/438 |

FOREIGN PATENT DOCUMENTS

| | | |
|---|---|---|
| WO | 01/45615 | 6/2001 |
| WO | 2006/028912 | 3/2006 |

* cited by examiner

*Primary Examiner* — Lorna M Douyon
(74) *Attorney, Agent, or Firm* — Shiela A. Loggins

(57) ABSTRACT

The present invention is based in part on the discovery that impregnating a cleaning substrate with a nonionic, linear polymer unexpectedly improves the cleaning efficacy of the article and prevents redeposition of soil and dirt onto the cleaned hard or soft surface. The nonionic, linear polymer is, for example, polyacrylamide. In addition, a method of incorporation of a cleaning composition into said substrate is disclosed.

16 Claims, No Drawings

PREMOISTENED CLEANING DISPOSABLE SUBSTRATE AND METHOD OF INCORPORATION OF A CLEANING COMPOSITION INTO SAID SUBSTRATE

This application claims benefit under 35 USC 119(e) of U.S. Provisional app. No. 60/859,913, filed on Nov. 17, 2006, which is incorporated herein by reference.

FIELD OF THE INVENTION

The present invention is directed to a premoistened, disposable, cleaning substrate to improve dirt pick-up and to retard redeposition of the dirt back onto the cleaned hard or soft surface. The said substrate is incorporated therein with linear nonionic polymers to improve cleaning. The substrate can be employed to clean hard surfaces such as floors, counter-tops, toilets, windows, and autos as well as soft surfaces on clothing, furnishings, and carpets. In addition, a method of incorporation of a cleaning composition into said substrate is disclosed.

BACKGROUND OF THE INVENTION

Household dirt and soil are usually removed from hard and soft surfaces with a cloth, sponge or other similar hand held implement. To facilitate dirt and soil removal, there are numerous commercially available surface cleaning compositions in the prior art. Generally, the liquid cleaners consist of some small percentage of surfactant, such as a nonionic, cationic or anionic surfactant, a solvent, such as an alcohol, ammonium hydroxide, a builder, chelating agents, preservatives, biocides and water. A perfume may be added to impart a pleasant fragrance to the cleaner, as well as to mask the unpleasant odor of the solvent and/or surfactant, and, perhaps, a dye to is added impart a pleasant color to the cleaning composition.

Liquid cleaners have limited cleaning efficiency with respect to particular types of soils, and are subject to streaking or redepositing of soil on the surface. The art is in need of techniques to improve the cleaning efficiency of cleaning substrates especially with respect to soil and dirt pickup. In particular, the techniques should be compatible and/or usable with existing cleaning products.

US 2006/0052269 discloses premoistened disposable wipes for cleaning fabric-based materials herein incorporated by reference.

U.S. Pat. No. 7,048,806 discloses cleaning wipes containing polycationic polymers herein incorporated by reference.

U.S. Pat. No. 5,507,968 discloses a cleansing article comprising a controlled release detergent composition herein incorporated by reference.

U.S. Pat. No. 6,653,274 discloses a hard surface detergent composition containing a soil entrainment system herein incorporated by reference.

U.S. Pat. No. 7,049,281 discloses all purpose liquid cleaning compositions effective for the removal of oily and greasy soil contaminants herein incorporated by reference.

U.S. Pat. No. 6,716,805 discloses hard surface cleaning compositions along with specific instructions for use herein incorporated by reference.

U.S. Pat. No. 6,251,849 discloses cationic polymers used as soil release compounds in hard surface cleaners herein incorporated by reference.

US 2005/0192199 discloses a dilutable cleaning composition for flocculating soil during use herein incorporated by reference.

U.S. Pat. No. 5,368,779 discloses detergent formulations for cleaning equipment and processing materials of dirt, oil, heavy metals and the like herein incorporated by reference.

U.S. Pat. No. 5,326,492 and U.S. Pat. No. 5,348,678 disclose disinfectant mixtures containing water soluble cleaning agents herein incorporated by reference.

U.S. Pat. No. 4,820,450 discloses cleaning solutions to precipitate and settle dirt particles herein incorporated by reference.

U.S. Pat. No. 4,624,890 discloses a wiping article suitable for wiping glossy hard surfaces herein incorporated by reference.

U.S. Pat. No. 4,014,808 discloses a detergent composition useful for cleaning soiled surfaces herein incorporated by reference.

Accordingly, there is still a need for a premoistened cleaning substrate for cleaning soft and hard surfaces with improved cleaning efficacy. There is a further need for such a method of cleaning hard and soft surfaces.

SUMMARY OF THE INVENTION

The present invention is based in part on the discovery that impregnating a cleaning substrate with a nonionic, linear polymer unexpectedly improves the cleaning efficacy of the article and prevents redeposition of soil and dirt onto the cleaned hard or soft surface. The nonionic, linear polymer is, for example, polyacrylamide.

In another aspect, the invention is directed to a method of incorporation of a cleaning composition into a single layer absorbent material producing a premoistened cleaning disposable substrate that comprises the steps of:

a) obtaining a single or multi-layered absorbent material; and b) incorporating therein a cleaning composition.

DETAILED DESCRIPTION OF THE INVENTION

The present invention relates to a premoistened cleaning disposable substrate for cleaning hard or soft surfaces. The substrate comprises a single-layered substrate and a cleaning composition. The cleaning composition comprises: i) from about 0.001% to about 5% by weight of linear, nonionic polyacrylamide; ii) from about 0.25% to about 15% by weight of a non-volatile organic solvent; iii) from about 0.001% to about 15% by weight of at least one detersive surfactant; iv) optionally from about 0% to about 5% by weight of other cleaning polymers; and v) balance water.

The polyacrylamide is linear and nonionic. The polyacrylamide is a high molecular weight polymer having a weight average molecular weight of about 5,000,000 to about 25,000,000 Daltons. More preferably, the weight average molecular weight of the polyacrylamide is at least about 10,000,000 to about 20,000,000 Daltons; and most preferably the weight average molecular weight is between about 10,000,000 and about 15,000,000 Daltons.

Excessive amounts of polyacrylamide should be avoided since this may cause the substrate to become too "tacky" resulting in a high coefficient of friction in use. Preferably, the polyacrylamide in use is non-tacky and does not substantially contribute to the coefficient of friction. When incorporated as part of an aqueous cleaning composition, the linear nonionic polymer, polyacrylamide, typically comprises from about 0.001% to about 5.0% or typically comprises from about 0.001% to about 2.0% or typically comprises from about 0.001% to about 0.5% of the cleaning composition. (All percentages herein are based on weight unless otherwise noted.)

Within the context of this patent, the term linear refers to a polymer that is not crosslinked.

The cleaning compositions can also include one or more non-volatile organic solvents at effective levels, typically from about 0.25% by weight of the composition to about 15% by weight of the composition, or from about 0.5% by weight of the composition to about 10% by weight of the composition, or from about 1% by weight of the composition to about 5%, by weight of the composition. The nonionic linear polymer, polyacrylamide, provides cleaning and/or wetting even without an organic cleaning solvent present. However, the cleaning can normally be further improved by the use of the right organic cleaning solvent.

For the purpose of this patent, the non-volatile organic solvent has a vapor pressure of less than about 0.1 mm of mercury at 20 C. or has a boiling point of at least about 230 C.

Due to their low volatility, these solvents tend not to evaporate rapidly and allow sufficient "working" time for the wipe before it dries out. Preferred solvents are esters and glycol ethers. The most preferred solvents are glycol ethers of high boiling point.

Such solvents typically have a terminal C3-C6 hydrocarbon attached to from two to three alkylene glycol moieties to provide the appropriate degree of hydrophobicity, high boiling point (or low vapor pressure) and, preferably, surface activity. Examples of commercially available hydrophobic cleaning solvents based on alkylene glycol chemistry include Triethyleneglycol monomethyl ether (Methoxytriglycol ether from Dow Chemicals), Diethylene glycol monoethyl ether (Carbitol Solvent from Dow Chemicals), Triethyleneglycol monoethyl ether (Ethoxytriglycol from Dow Chemicals), diethyleneglycol butylether (Butyl Carbitol), Triethyleneglycol monobutyl ether (Butoxytriglycol ether), Diethyleneglycol monohexyl ether (Hexyl Carbitol), ethylene glycol phenyl ether (Dowanol EPh), Dipropyleneglycol methyl ether (Dowanol DPM), Tripropylene glycol methyl ether (Dowanol TPM), Dipropylene glycol methylether acetate (Dowanol DPMA), Dipropylene glycol n Propyl ether (Dowanol DPnP), Tripropyleneglycol n propyl ether (Dowanol TPnP), dipropyleneglycol n-butyl ether (Dowanol DPnB), Tripropylene glycol n-butyl ether (Dowanol TPnB), Propyleneglycol phenyl ether (Dowanol PPh). These solvents are commercially available from Dow Chemicals (1691 N. Swede Road, Midland, Mich.).

Additional solvents of this class are available from Clariant GmbH of Werk Gendorf, Germany. Examples include Methyl tetraglycol (from Clariant GmbH), and buyl polyglycol (from Clariant GmbH).

Other suitable solvents include but are not limited to alkyl pyrrolidone.

The cleaning compositions herein may comprise from about 0.001% to 15% by weight of a detersive surfactant. Preferably such compositions comprise from about 0.01% to 2% by weight of surfactant. More preferably such compositions comprise from about 0.01% to 0.5% by weight of surfactant. Detersive surfactants are preferably, zwitterionic or amphoteric or nonionic type or can comprise compatible mixtures of these types. Detergent surfactants useful herein are described in U.S. Pat. No. 3,664,961; U.S. Pat. No. 3,919,678; U.S. Pat. No. 4,222,905; and in U.S. Pat. No. 4,239,659. All of these patents are incorporated herein by reference.

Non-limiting examples of nonionic surfactants include: a) C12-C18 alkyl ethoxylates, such as, NEODOL® nonionic surfactants from Shell; b) C6-C12 alkyl phenol alkoxylates wherein the alkoxylate units are a mixture of ethyleneoxy and propyleneoxy units; c) C12-C18 alcohol and C6-C12 alkyl phenol condensates with ethylene oxide/propylene oxide block polymers such as Pluronic® from BASF; d) C14-C22 mid-chain branched alcohols, BA, as disclosed in U.S. Pat. No. 6,150,322; e) C14-C22 mid-chain branched alkyl alkoxylates, BAEx, wherein x 1-30, as disclosed in U.S. Pat. Nos. 6,153,577, 6,020,303, and 6,093,856; f) alkyl polysaccharides as disclosed in U.S. Pat. No. 4,565,647; specifically alkylpolyglycosides as disclosed in U.S. Pat. Nos. 4,483,780 and 4,483,779; g) Polyhydroxy fatty acid amides as disclosed in U.S. Pat. No. 5,332,528, WO 92/06162, WO 93/19146, WO 93/19038, and WO 94/09099; h) ether capped poly(oxyalkylated) alcohol surfactants as disclosed in U.S. Pat. No. 6,482,994 and WO 01/42408; and i) amine oxides.

Preferred surfactants for use herein are the alkylpolysaccharides that are disclosed in U.S. Pat. No. 5,776,872; U.S. Pat. No. 5,883,059; U.S. Pat. No. 5,883,062; and U.S. Pat. No. 5,906,973.

Suitable alkylpolysaccharides for use herein are disclosed in U.S. Pat. No. 4,565,647, having a hydrophobic group containing from about 6 to about 30 carbon atoms, preferably from about 10 to about 16 carbon atoms and a polysaccharide, e.g., a polyglycoside, hydrophilic group. For acidic or alkaline cleaning compositions/solutions suitable for use in no-rinse methods, the preferred alkyl polysaccharide preferably comprises a broad distribution of chain lengths, as these provide the best combination of wetting, cleaning, and low residue upon drying. This "broad distribution" is defined by at least about 50% of the chainlength mixture comprising from about 10 carbon atoms to about 16 carbon atoms. Preferably, the alkyl group of the alkyl polysaccharide consists of a mixtures of chainlength, preferably from about 6 to about 18 carbon atoms, more preferably from about 8 to about 16 carbon atoms, and hydrophilic group containing from about one to about 1.5 saccharide, preferably glucoside, groups per molecule. This "broad chainlength distribution" is defined by at least about 50% of the chainlength mixture comprising from about 10 carbon atoms to about 16 carbon atoms. A broad mixture of chain lengths, particularly C8-C16, is highly desirable relative to narrower range chain length mixtures, and particularly versus lower (i.e., C8-C10 or C8-C12) chainlength alkyl polyglucoside mixtures. It is also found that the preferred C8-C16 alkyl polyglucoside provides much improved perfume solubility versus lower and narrower chainlength alkyl polyglucosides, as well as other preferred surfactants, including the C8-C14 alkyl ethoxylates. Any reducing saccharide containing 5 or 6 carbon atoms can be used, e.g., glucose, galactose and galactosyl moieties can be substituted for the glucosyl moieties. (optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units. The glycosyl is preferably derived from glucose.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides and/or galactoses. Suitable mixtures include coconut alkyl, di-, tri-, tetra-, and pentaglucosides and tallow alkyl tetra-, penta- and hexaglucosides.

To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

In the alkyl polyglycosides, the alkyl moieties can be derived from the usual sources like fats, oils or chemically produced alcohols while their sugar moieties are created from hydrolyzed polysaccharides. Alkyl polyglycosides are the condensation product of fatty alcohol and sugars like glucose with the number of glucose units defining the relative hydrophilicity. As discussed above, the sugar units can additionally be alkoxylated either before or after reaction with the fatty alcohols. Such alkyl polyglycosides are described in detail in WO 86/05199 for example. Technical alkyl polyglycosides are generally not molecularly uniform products, but represent mixtures of alkyl groups and mixtures of monosaccharides and different oligosaccharides. Alkyl polyglycosides (also sometimes referred to as "APG's") are preferred for the purposes of the invention since they provide additional improvement in surface appearance of the surface being cleaned relative to other surfactants. The glycoside moieties are preferably glucose moieties. The alkyl substituent is preferably a saturated or unsaturated alkyl moiety containing from about 8 to about 18 carbon atoms, preferably from about 8 to about 10 carbon atoms or a mixture of such alkyl moieties. C8-C16 alkyl polyglucosides are commercially available (e.g., Simusol® surfactants from Seppic Corporation, 75 Quai d'Orsay, 75321 Paris, Cedex 7, France, and Glucopon®425 available from Henkel). In the present invention, the preferred alkyl polyglucosides are those which have been purified enough for use in personal cleansing. Most preferred are "cosmetic grade" alkyl polyglucosides, particularly C8 to C16 alkyl polyglucosides, such as Plantaren 2000®, Plantaren 2000 N®, and Plantaren 2000 N UP®, available from Henkel Corporation (Posffach 1101100, D 40191 Dusseldorf, Germany). Examples are N-methyl N-1-deoxyglucityl cocoamide and N-methyl N-1-deoxyglucityl oleamide. Processes for making polyhydroxy fatty acid amides are known and can be found in U.S. Pat. No. 2,965,576 and U.S. Pat. No. 2,703,798.

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 column 19, line 38 through column 22, line 48, for examples of zwitterionic surfactants; betaine, including alkyl dimethyl betaine and cocodimethyl amidopropyl betaine, C8 to C18 (preferably C12 to C18) amine oxides and sulfo and hydroxy betaines, such as N-alkyl-N,N-dimethylamino-1-propane sulfonate where the alkyl group can be C8 to C18, preferably C10 to C14.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 column 19, lines 18-35, for examples of ampholytic surfactants.

Nonlimiting examples of anionic surfactants useful herein include: a) C11-C18 alkyl benzene sulfonates (LAS); b) C10-C20 primary, branched-chain and random alkyl sulfates (AS); c) C10-C18 secondary (2,3) alkyl sulfates; d) C10-C18 alkyl alkoxy sulfates (AEXS) wherein preferably x is from 1-30; e) C10-C18 alkyl alkoxy carboxylates preferably comprising 1-5 ethoxy units; f) mid-chain branched alkyl sulfates as disclosed in U.S. Pat. Nos. 6,020,303 and 6,060,443; g) mid-chain branched alkyl alkoxy sulfates as disclosed in U.S. Pat. Nos. 6,008,181 and 6,020,303; h) modified alkylbenzene sulfonate (MLAS) as disclosed in: WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Non-limiting examples of cationic surfactants include: the quaternary ammonium surfactants, which can have up to 26 carbon atoms; a) alkoxylate quaternary ammonium (AQA) surfactants as disclosed in U.S. Pat. No. 6,136,769; b) dimethyl hydroxyethyl quaternary ammonium as disclosed in U.S. Pat. No. 6,004,922; c) polyamine cationic surfactants as disclosed in WO 98/35002, WO 98/35003, WO 98/35004, WO 98/35005, and WO 98/35006; d) cationic ester surfactants as disclosed in U.S. Pat. Nos. 4,228,042, 4,239,660, 4,260,529 and 6,022,844; e) amino surfactants as disclosed in U.S. Pat. No. 6,221,825 and WO 00/47708, specifically amido propyldimethyl amine; and f) ethoxylated and propoxylated quaternary ammonium compounds.

Non-limiting examples of semi-polar nonionic surfactants include: water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms. See WO 01/32816, U.S. Pat. No. 4,681,704, and U.S. Pat. No. 4,133,779.

Cleaning compositions of the present invention optionally comprise from about 0%, to about 5%, or from about 0.001 to about 5% of a cleaning polymer, or from about 0.01 to about 2% of a cleaning polymer, or from about 0.01 to about 0.5% of a cleaning polymer, wherein said polymer comprises at least one cationically charged unit, inter alia, quaternary ammonium moiety or unit which can form a cationic charge in situ, inter alia, an amine moiety. Stated in another way, the oligomer, polymer, or co-polymer resulting from the herein below described monomer units have one net cationic charge at a pH=7. The charge can be distributed among any of the herein described units.

The cleaning polymer(s) adsorbs irreversibly on the non-woven substrate and helps clean or trap the dirt on it. This prevents the dirt from being smeared around or redeposited on the surface that is being cleaned.

Cationic polymers in general and their method of manufacture are known in the literature. For example, a detailed description of cationic polymers can be found in an article by M. Fred Hoover that was published in the Journal of Macromolecular Science-Chemistry, A4(6), pp 1327-1417, October, 1970. The entire disclosure of the Hoover article is incorporated herein by reference. Other suitable cationic polymers are those used as retention aids in the manufacture of paper. They are described in "Pulp and Paper, Chemistry and Chemical Technology Volume III edited by James Casey (1981). The molecular weight of these polymers is in the range of 2000-5 million.

The cleaning polymers of this invention will be better understood when read in light of the Hoover article and the Casey book, the present disclosure and the Instant Examples herein.

Suitable cleaning polymers are listed below.

Polyacrylic acid type polymers and its derivatives such as Acusol type or GLASCOL E-11.

Polyethyleneimine and its derivatives. These are commercially available under the trade name Lupasol ex. BASF AG of Ludwigschaefen, Germany.

Polyamidoamine-epichlorohydrin (PAE) Resins which are condensation products of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington, Del. under the trade name Kymene or from BASF A.G. under the trade name Luresin.

These polymers are described in Wet Strength Resins and Their Applications edited by L. L. Chan, TAPPI Press (1994).

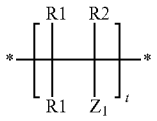

wherein t is repeating unit, R1, R2, and Z1 are defined herein below. The linear polymer units are typically formed from linearly polymerizing monomers. Linearly polymerizing monomers are defined herein as monomers which under standard polymerizing conditions result in a linear polymer chain or alternatively which linearly propagate polymerization. The linearly polymerizing monomers of the present invention have the formula:

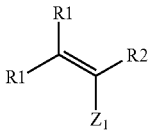

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each R1 is independently hydrogen, C1-C4 alkyl, substituted or unsubstituted phenyl, substituted or unsubstituted benzyl, carbocyclic, heterocyclic, and mixtures thereof. Preferably R1 is hydrogen, C1-C4 alkyl, phenyl, and mixtures thereof, more preferably hydrogen and methyl.

Each R2 is independently hydrogen, halogen, C1-C4 alkyl, C1-C4 alkoxy, substituted or unsubstituted phenyl, substituted or unsubstituted benzyl, carbocyclic, heterocyclic, and mixtures thereof. Preferred R2 is hydrogen, C1-C4 alkyl, and mixtures thereof.

Each Z1 is independently hydrogen; hydroxyl; halogen; —(CH2)mR, wherein R is hydrogen, hydroxyl, halogen, nitrilo, —OR3, —O(CH2)nN(R3)$_2$, —O(CH2)nN+(R3)3X—, —OCO(CH2)nN(R3)$_2$, —OCO(CH2)nN+(R3)3X—, —C(O)NH—(CH2)nN(R3)2, —C(O)NH(CH2)nN+(R3)3X—, —(CH2)nN(R3)$_2$, —(CH2)nN+(R3)$_3$X—, a non-aromatic nitrogen heterocycle comprising a quaternary ammonium ion, a non-aromatic nitrogen heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; —NHCHO (formamide), or mixtures thereof; wherein each R3 is independently hydrogen, C1-C8 alkyl, C2-C8 hydroxyalkyl, and mixtures thereof; X is a water soluble anion; the index n is from 1 to 6; carbocyclic, heterocyclic, or mixtures thereof; —(CH2)mCOR' wherein R' is —OR3, —O(CH2)nN(R3)$_2$, —O(CH2)nN+(R3)3X—, —NR3(CH2)nN(R3)$_2$, —NR3(CH2)nN+(R3)3X—, —(CH2)nN(R3)$_2$, —(CH2)nN+(R3)3X—, or mixtures thereof, wherein R3, X, and n are the same as defined herein above. A preferred Z1 is —O(CH2)nN+(R3)3X—, wherein the index n is 2 to 4. The index m is from 0 to 6, preferably 0 to 2, more preferably 0.

Non-limiting examples of addition polymerizing monomers comprising a heterocyclic Z1 unit includes 1-vinyl-2-pyrrolidinone, 1-vinylimidazole, 2-vinyl-1,3-dioxolane, 4-vinyl-1-cyclohexene1,2-epoxide, and 2-vinylpyridine.

The cleaning polymers and co-polymers of the present invention comprise Z1 units which have a cationic charge or which result in a unit which forms a cationic charge in situ. When the co-polymers of the present invention comprise more than one Z1 unit, for example, Z1, Z2, Z3, . . . Zn units, at least about 1% of the monomers which comprise the co-polymers will comprise a cationic unit. Preferred cationic units include —O(CH2)nN+(R3)3X— and —(CH2)nN+(R3)3X—. When the co-polymers of the present invention are formed from two monomers, Z1 and Z2, the ratio of Z1 to Z2 is preferably from about 9:1 to about 1:9.

A non-limiting example of a Z1 unit which can be made to form a cationic charge in situ is the —NHCHO unit, formamide. The formulator can prepare a polymer or co-polymer comprising formamide units some of which are subsequently hydrolyzed to form vinyl amine equivalents. For example, the formulator may prepare a co-polymer having the general formula:

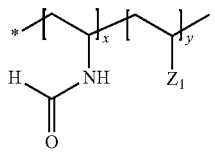

which comprises a formamide unit and then subsequently treat the co-polymer such that some of the formamide units are hydrolyzed to form a co-polymer comprising vinyl amine units, said polymer having the formula:

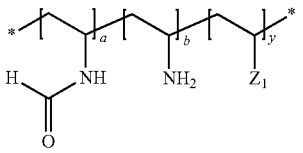

wherein Z1 may be a cationic unit comprising or non-cationic unit comprising moiety and a+b=x.

Another class of preferred linearly polymerizable monomers comprise cationically charged heteroaromatic Z1 units having the formula:

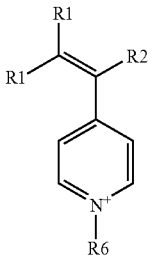

an non-limiting example of which is 4-vinyl (N-alkyl)pyridine wherein R1 and R2 are each hydrogen and R6 is methyl.

Another class of preferred linearly polymerizable monomers which comprises a heterocyclic ring includes Z units comprising an N-oxide, for example, the N-oxide having the formula:

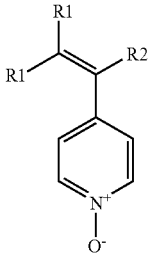

a non-limiting example of which is 4-vinyl pyridine N-oxide.

N-alkyl vinylpyridine monomers and N-oxide vinylpyridine monomers can be suitably combined with other non aromatic monomers, inter alia, vinyl amine. However, preferred polymers of the present invention include co-polymers derived from a combination of quaternized, N-oxide, and nitrogen containing heteroaromatic monomers, non-limiting examples of which includes a copolymer of N-methyl vinyl pyridine and vinyl pyridine in a ratio of 4:1; a copolymer of N-methyl vinyl pyridine and vinyl pyridine in a ratio of 4:6; a co-polymer of poly(N-methyl vinyl pyridine) and vinyl pyridine N-oxide in a ratio of polymer to monomer of 4:1; poly (N-methyl vinyl pyridine) and vinyl pyridine N-oxide in a ratio of polymer to monomer of 4:6; and mixtures thereof.

As described herein above, some preferred polymer residues may be formed by treatment of the resulting polymer. For example, vinyl amine residues are preferably introduced via formamide monomers which are subsequently hydrolyzed to the free amino unit. Also vinyl alcohol units are obtained by hydrolysis of residues formed form vinyl acetate monomers. Likewise, acrylic acid residues may be esterified after polymerization, for example, units having the formula:

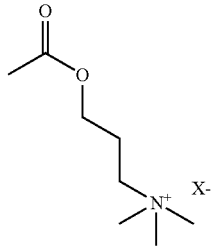

may be more conveniently formed after the backbone has been formed by polymerization with acrylic acid or acrylic acid precursor monomers.

The cleaning polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

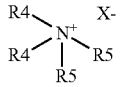

wherein each R4 is independently an olefin comprising unit which is capable of propagating polymerization in addition to forming a cyclic residue with an adjacent R4 unit; R5 is C1-C12 linear or branched alkyl, benzyl, substituted benzyl, and mixtures thereof; X is a water soluble anion.

Non-limiting examples of R4 units include allyl and alkyl substituted allyl units. Preferably the resulting cyclic residue is a six-member ring comprising a quaternary nitrogen atom.

R5 is preferably C1-C4 alkyl, preferably methyl.

An example of a cyclically polymerizing monomer is dimethyl diallyl ammonium having the formula:

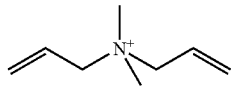

which results in a polymer or co-polymer having units with the formula:

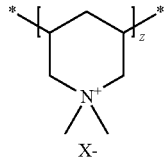

wherein preferably the index z is from about 10 to about 50,000.

The cleaning polymers or co-polymers of the present invention retain a net cationic charge, whether the charged is developed in situ, or whether the polymer or co-polymer itself has a formal positive charge. Preferably the polymer or co-polymer has at least 10%, more preferably at least about 25%, more preferably at least about 35%, most preferably at least about 50% of the residues comprise a cationic charge.

The cleaning polymers or co-polymers of the present invention can comprise mixtures of linearly and cyclically polymerizing monomers, for example the poly(dimethyldiallyl-ammonium chloride/acrylamide) co-polymer having the formula:

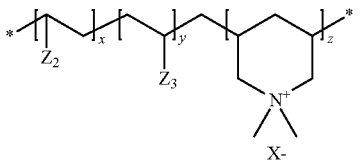

wherein Z2, Z3, x, y, and z are the same as defined herein above and X is chloride ion.

One embodiment of this invention is the composition comprising a polymer based on dimethyldiallylammonium chloride and a copolymer which is based upon acrylamide with a co-monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaternized derivatives and mixtures thereof.

Non-limiting examples of polymers suitable for use with the present invention include cleaning copolymers comprising: i) a first monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaternized derivatives, vinylamine or its derivatives, allylamine or its derivatives and mixtures thereof; and ii) a second monomer selected from the group consisting of acrylic acid, methacrylic acid, C1-C6 alkylmethacrylate, C1-C6 alkyl acrylate, C1-C8 hydroxyalkylacrylate, C1-C8 hydroxyalkylmethacrylate, acrylamide, C1-C16 alkyl acrylamide, C1-C16 dialkylacrylamide, 2-acrylamido-2-methylpropane sulfonic acid or its alkali salt, methacrylamide, C1-C16 alkylmethacrylamide, C1-C16 dialkylmethacrylamide, vinyl formamide, vinylacetamide, vinyl alcohol, C1-C8 vinylalkylether, vinyl pyridine, itaconic acid, vinyl acetate, vinyl propionate, vinyl butyrate and mixtures thereof;

Cationic polysaccharides preferably cationic hydroxyethyl cellulose, cationic guar gum and cationic starches. Examples of cationic hydroxyethyl cellulose is Ucare Polymer JR 25M, Polymer JR 400, Polymer LK 400 and Polymer LR 400 all available from Dow Chemicals Co and Celquat H200 and Celquat L-200 available from National Starch and Chemical Company or Bridgewater, N.J.

Examples of cationic guar gums are Jaguar C13 and Jaguar Excel available from Rhodia Examples of cationic starches are described by D. B. Solarek in Modified Starches, Properties and Uses published by CRC Press (1986). Cationic starches are commercially available from National Starch and Chemical Company under the Trade Name Cato.

The cleaning composition may optionally contain other ingredients. Non-limiting examples of these other optional ingredients include detersive builders, enzymes, enzyme stabilizers (non-limiting examples of which include propylene glycol, boric acid and/or borax), foam control agents, soil suspending agents, soil release agents, pH adjusting agents, chelating agents, phase stabilizers, solubilizers, brighteners, preservatives, antimicrobial agents, coloring agents, and mixtures thereof.

The present invention also relates to a cleaning implement that includes a substrate that has been impregnated with a nonionic linear polymer of the instant invention or the cleaning composition of the instant invention. In addition, the invention relates to methods of cleaning hard and soft surfaces using the so-impregnated substrate.

It has been demonstrated that using the nonionic linear polymer by incorporating it into a substrate results in significant cleaning efficiency. Because the premoistened disposable cleaning substrate could more efficiently prevent dirt from being redeposited, the amount of actives in the substrate could be reduced to achieve the same amount of cleaning. Thus an aqueous glass cleaner composition would require essentially no surfactant when it is employed in the cleaning substrate of the instant invention to clean glass that is scrubbed with the said substrate.

In addition, the presence lower active levels in the substrate containing the cleaning composition will exhibit the concomitant effect of improve filming/streaking as less of these cleaning actives are available to be redeposited on the surface being cleaned.

In use, the nonionic linear polymers are applied directly onto the cleaning surface of a substrate. Thereafter, "wet" or premoistened substrate can be formed when the aqueous cleaning composition, which contains the nonionic linear polymers and one or more additional components, is incorporated or adsorbed into the substrate. The data described herein evidence that the wet or premoistened substrates will adhere large amounts of dirt.

The term "substrate" refers to any suitable natural and/or synthetic adsorbent and/or adsorbent material that can be employed to clean hard and soft surfaces by physical contact, e.g, wiping, scrubbing, buffing, polishing, rinsing, and the like. Preferred substrates are non-woven which means that the material is formed without the aid of a textile weaving or knitting process. The non-woven material can comprise, for example, non-woven, fibrous sheet materials or meltblown, coform, air-laid, spun bond, wet laid, bonded-carded web materials, and/or hydroentangled (also known as spunlaced) materials. The substrate can also include wood pulp, a blend of wood pulp, and/or synthetic fibers, e.g., polyester, RAYON, NYLON, polypropylene, polyethylene, and/or cellulose polymers. The substrate consists of a single-layered structure and is not a multilayered laminate.

The substrate can incorporate a backing member that may be pervious or impervious to a cleaning composition. The backing member provides structural support to the substrate, imparts texture to the substrate, and/or provides a prophylactic barrier. The backing member can be manufactured from any suitable material including, for example, woven or non-woven material, polymeric material, natural fiber, synthetic fiber, or mixtures thereof.

A preferred substrate is manufactured in the form of a general purpose cleaning wipe that has at least one layer of non-woven absorbent or adsorbent material. The wipe can further include wood pulp or a blend of wood pulp and a synthetic fiber, without limitation, such as polyester, RAYON, NYLON, polypropylene, polyethylene, other cellulose polymers; or a synthetic fiber or mixture of such fibers. A binder may or may not be present. Manufacturers include Kimberly-Clark, E.I. du Pont de Nemours and Company, Dexter, American Nonwovens, James River, BBA Nonwovens and PGI. Examples of such substrates are described in U.S. Pat. No. 6,340,663; U.S. Pat. No. 4,781,974; U.S. Pat. No. 4,615,937; U.S. Pat. No. 4,666,621; U.S. Pat. No. 5,908, 707; WO 98/03713; WO 97/40814; WO 96/14835; and EP 750063, all of the U.S. patents are incorporated herein by reference.

Woven or absorbent materials, such as cotton fibers, cotton/nylon blends, or other textiles may also be used in the substrate. Regenerated cellulose, polyurethane foams, and the like, which are used in making sponges, may also be suitable for use herein.

The cleaning substrate's liquid loading capacity should be at least about 50% to about 1000% by weight based on the dry weight thereof; more preferably at least about 200% to about 800% of the dry weight thereof; and most preferably at least about 200% to about 500% of the dry weight thereof. This is expressed as loading ½ to 10 times the weight (or, more accurately, the mass) of the substrate. The substrate varies without limitation from about 0.01 to about 1,000 grams per square meter, most preferably 25 to 120 grams/m2 (referred to as "basis weight") and typically is produced as a sheet or web, which is cut, die-cut, or otherwise sized into the appropriate shape and size.

The cleaning substrate can be individually sealed with a heat-sealable or glueable thermoplastic overwrap (such as polyethylene, MYLAR, and the like). More preferably the wipes can be packaged as numerous, individual sheets which are then impregnated or contacted with the dirt-attracting polycationic polymer or with a liquid cleaning composition containing the dirt-attracting polycationic polymer. Even more preferably, the wipes can be formed as a continuous web during the manufacturing process and loaded into a dispenser, such as a canister with a closure, or a tub with closure. The closure is to seal the moist wipes from the external environment and to prevent premature volatilization of the liquid ingredients. Without limitation, the dispenser may be formed of plastic, such as high density polyethylene, polypropylene, polycarbonate, polyethylene terepthalate (PET), polyvinyl chloride (PVC), or other rigid plastics. The continuous web of wipes could preferably be threaded through a thin opening in the top of the dispenser, most preferably, through the closure. A means of sizing the desired length or size of the wipe from the web would then be needed. A knife blade, serrated edge, or other means of cutting the web to desired size can be provided on the top of the dispenser, for non-limiting example, with the thin opening actually doubling in duty as a cutting edge. Alternatively, the continuous web of wipes could be scored, folded, segmented, or partially cut into uniform or non-uniform sizes or lengths, which would then obviate the need for a sharp cutting edge. Further, as in hand tissues, the wipes could be interleaved, so that the removal of one wipe advances the next, and so forth.

The cleaning wipes will preferably have a certain wet tensile strength which is without limitation about 25 to about 250 Newtons/m, more preferably about 75 to about 170 Newtons/m.

Another preferred substrate is manufactured in the form of clean pads for used in conjunction with handheld implements that are described, for example, in U.S. Pat. No. 6,540,424, which is incorporated herein. As described in U.S. Pat. No. 6,540,424, the cleaning pad consists of a cleaning surface, which comes into direct contact with dirt and debris. This surface comprises an absorbent material which has the ability to absorb fluid, including superabsorbent materials. The cleaning pad preferably has a polyethylene film backing layer that is bonded to the cleaning surface. The film backing layer can be formed of polyethylene or any suitable plastic, rubber, other elastomeric, polymeric or other flexible material.

Suitable materials for the cleaning surface of the cleaning pad are absorbent materials such as the unbonded web material described in U.S. Pat. No. 5,858,112 and U.S. Pat. No. 5,962,112. Other suitable materials are described by U.S. Pat. No. 4,720,415 and superabsorbent materials are described in U.S. Pat. No. 4,995,133; U.S. Pat. No. 5,638,569; U.S. Pat. No. 5,960,508; and U.S. Pat. No. 6,003,191, all of which are incorporated by reference herein.

In a preferred embodiment, the cleaning pad substrate comprises a spunbond fiber non-woven web. The spunbond fibers comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity.

Alternatively, the absorbent material for the cleaning pad comprises a laminate of an air-laid composite and a spunbond fiber nonwoven web. The non-woven web comprises monocomponent spunbond fibers of polypropylene having a basis weight of approximately 14 grams per square meter. The air-laid composite comprises from about 85% to about % kraft pulp fluff and from about 10% to about 15% bicomponent staple fibers. The bicomponent staple fibers have a sheath-core configuration; the core component comprises polyethylene terephthalate and the sheath component comprises polyethylene.

The cleaning composition optionally contains one or more of the following adjuncts: stain blocking agents, stain and soil repellants, enzymes, lubricants, insecticides, miticides, anti-allergen agents, odor control agents, fragrances and fragrance release agents, brighteners or fluorescent whitening agents, oxidizing or reducing agents, polymers which leave a film to trap or adsorbs bacteria, virus, mite, allergens, dirt, dust, or oil.

The cleaning composition may include additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermacet, candelilla, paraffin, lanolin, shellac, esparto, ouricuri, polyethylene wax, chlorinated naphthaline wax, petrolatu, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. DANTAGARD and/or GLYDANT) and/or short chain alcohols (e.g. ethanol and/or IPA).

The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, Na.sup.+ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

An antimicrobial agent can also be included in the cleaning composition. Non-limiting examples of useful quaternary compounds that function as antimicrobial agents include benzalkonium chlorides and/or substituted benzalkonium chlorides, di(C6 C14)alkyl di short chain (C1-4 alkyl and/or hydroxyalkyl) quaternaryammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyldimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the low-surfactant compositions, range from about 0.001% to about 0.8% and preferably from about 0.005% to about 0.3% of the usage composition. The weight percentage ranges for the biguanide and/or quat compounds in the cleaning composition is selected to disinfect, sanitize, and/or sterilize most common household and industrial surfaces.

Non-quaternary biocides are also useful. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, other silver compounds, for example, silver dicitrate, quaternary phosphate compounds, and phenolics.

These antimicrobial, antifungal or antiallergen materials include water-soluble, film-forming polymers (U.S. Pat. No. 6,454,876, which is incorporated herein by reference), quaternary ammonium compounds and complexes therewith (U.S. Pat. Nos. 6,482,392; 6,080,387; 6,284,723; 6,270,754; 6,017,561; and 6,013,615, all of which are incorporated herein by reference), essential oils, such as nerolidol (U.S. Pat. No. 6,361,787, incorporated by reference), KATHON (U.S. Pat. No. 5,789,364 and U.S. Pat. No. 5,589,448, which are incorporated herein by reference), and, possibly, bleaches, such as hydrogen peroxide and alkali metal hypochlorite.

Optional miticides include boron compounds and salts, including boric acid, borates, octaborate, tetraborate, borax, and metaborate. Other optional miticides include benzylbenzoate, phenyl salicylate, diphenylamine, methyl p-naphthyl ketone, coumarin, phenethyl benzoate, benzyl salicylate, phenyl benzoate, N-fluorodichloromethylthio-cyclohexenedicarboxyimide, p-nitrobenzoic acid methyl ester, p-chlorometaxylenol, bromocinnamic aldehyde, 2,5-dichloro-4-bromophenol, N,N-dimethyl-N'-tryl-N'-(fluorodichloromethylthio)-sulfamide, 2-phenylphenol, sodium 2-phenylphenolate, 5-chloro-2-methyl-4-isothiazoline-3-one, 2-methyl-4-isothiazonoline-3-one, benzimidazolylmethyl-carbamate, the antimicrobials listed herein, and mixtures thereof.

Optional anti-allergen metal ions include metallic salts are selected from the group consisting of zinc, stannous, stannic, magnesium, calcium, manganese, titanium, iron, copper, nickel, and mixtures thereof. Other optional anti-allergen agents include polyphenol compounds including tannins, catechins, and gallic acid, hydrogen peroxide, salicylic acid, citric acid, lactic acid, glycolic acid, ascorbic acid, gluconic acid, pyruvic acid, glucaric acid, hydroxy benzoic acid, hydroxyglutamic acid, hydroxyphathalic acids, malic acid, and mixtures and salts thereof.

Film forming polymers can reduce allergens in the air. Suitable film-forming polymers include, water-soluble polymers selected from the group consisting of starch, polyvinyl alcohols, methyl cellulose and its derivatives, polyacrylic acids, polyethylene glycols with molecular weight higher than 5000, polyethylene, polypropylene glycol with molecular weight higher than 8000, Cosmetic Toiletry Fragrances Association polyquatemium compounds 1 through 14, polyvinyl pyrrolidone, and mixtures thereof. Specific examples of certain preferred film forming polymers are selected from the group consisting of hydroxy-propyl starch, DAISEL MC 1310, Kuraray poly vinyl alcohol 205, N-Polyvinyl-2 pyrrolidone, and mixtures thereof.

As used herein, the term "plant essential oil" or "plant essential oil compound" (which shall include derivatives thereof) generally refers to a monocyclic, carbocyclic ring structure having six-members and substituted by at least one oxygenated or hydroxyl functional moiety. These compounds can be added directly to the cleaning composition. Examples of plant essential oils encompassed within the present invention, include, but are not limited to, members selected from the group consisting of aldehyde C16 (pure), a-terpineol, amyl cinnamic aldehyde, amyl salicylate, anisic aldehyde, benzyl alcohol, benzyl acetate, cinnamaldehyde, cinnamic alcohol, carvacrol, carveol, citral, citronellal, citronellol, p-cymene, diethyl phthalate, dimethyl salicylate, dipropylene glycol, eucalyptol (cineole), eugenol, iso-eugenol, galaxolide, geraniol, guaiacol, ionone, menthol, menthyl salicylate, methyl anthranilate, methyl ionone, methyl salicylate, a-phellandrene, pennyroyal oil, perillaldehyde, 1- or 2-phenyl ethyl alcohol, 1- or 2-phenyl ethyl propionate, piperonal, piperonyl acetate, piperonyl alcohol, D-pulegone, terpinen-4-ol, terpinyl acetate, 4-tert-butylcyclohexyl acetate, thyme oil, thymol, metabolites of trans-anethole, vanillin, ethyl vanillin, cedarwood oil, hexadecyltrimethylammonium chloride, aluminium chlorohydrate, 1-propoxy-propanol-2, polyquarternium-10, silica gel, propylene glycol alginate, ammonium sulphate, hinokitiol, L-ascorbic acid, tannic acid and deriviatives, chlorohexidine, maleic anhydride, hinoki oil, a composite of AgCl and TiO2, diazolidinyl urea, 6-isopropyl-m-cresol, urea, cyclodextrin, hydrogenated hop oil, polyvinylpyrrolidone, N-methylpyrrolidone, the sodium salt of anthraquinone, potassium thioglycolate, and glutaraldehyde, jasmone, dihydrojasmone, lower alkyl esters of jasmonic acid, lower alkyl esters of dihydrojasmonic acid, farnesol, nerolidol, phytol, isophytol, geranylgeraniol, and the like. The essential oil can also be selected from oil is selected from the group of Anise, Balsam, Basil, Bay, Birch, Cajeput, Camphor, Caraway, Cinnamon, Clove, Coriander, Dill, Fennell, Fir, Garlic, Lavender, Lavendin, Lemongrass, Marjoram, Nutmeg, Peppermint, Pine, Rosemary, Rue, Sage, Spearmint, Tea Tree, Thuja, Thyme, Wintergreen and Ylang-Ylang. Preferred essential oils include a-terpineol, eugenol, cinnamic alcohol, benzyl acetate, 2-phenyl ethyl alcohol, and benzyl alcohol.

Soil resist agents resist or repel dirt, oil, or other typically hydrophobic substances from the carpet. Fluorochemical soil-resist agents may include polymers or compounds having pendent or end groups of perfluoroalkyl moieties, fluorosurfactants, or fluoro-intermediates. Examples of some suitable fluorochemical soil-resist agents include ZONYL 7950 and ZONYL 5180, which are available from DuPont. When employed the soil and stain resist agents are preferably present at a level of from 0.01% to 3% and preferably from 0.05% to 1% of the composition.

The optional stain-resist agent may also be selected from the group consisting of copolymers of hydrolyzed maleic anhydride with aliphatic alpha olefins, aromatic olefins, or vinyl ethers, poly (vinyl methyl ether/maleic acid) copolymers, homopolymers of methacrylic acid, and copolymers of methacrylic acid. Suitable poly (vinyl methyl ether/maleic acid) copolymers are commercially available, for instance, from ISP Corporation, New York, N.Y. and Montreal, Canada under the product names GANTREZ AN Copolymer (AN-119 copolymer, average molecular weight of 20,000; AN-139 copolymer, average molecular weight of 41,000; AN-149 copolymer, average molecular weight of 50,000; AN-169 copolymer, average molecular weight of 67,000; AN-179 copolymer, average molecular weight of 80,000), GANTREZ S (GANTREZ S97, average molecular weight of 70,000), and GANTREZ ES (ES-225, ES-335, ES-425, ES-435), GANTREZ V (V-215, V-225, V-425). Preferably, the stain-resist agent is ZELAN 338, which is available from DuPont.

Suitable anti-resoiling polymers also include soil suspending polyamine polymers. Particularly suitable polyamine polymers are alkoxylated polyamines including so-called ethoxylated polyethylene amines, i.e., the polymerized reaction product of ethylene oxide with ethyleneimine. Suitable ethoxylated polyethylene amines are commercially available from Nippon Shokubai CO., LTD under the product names ESP-0620A (ethoxylated polyethylene amine wherein n=2 and y=20) or from BASF under the product names ES-8165 and from BASF under the product name LUTENSIT K-187/50.

Suitable anti-resoiling polymers also include polyamine N-oxide polymers. The polyamine N-oxide polymer can be obtained in almost any degree of polymerization. Typically, the average molecular weight is within the range of 1,000 to 100,000; more preferred 5,000 to 100,000; most preferred 5,000 to 25,000. Suitable poly vinyl pyridine-N-oxide polymers are commercially available from Hoechst under the trade name of Hoe S 4268, and from Reilly Industries Inc. under the trade name of PVNO.

Furthermore, suitable anti-resoiling polymers include N-vinyl polymers. Suitable N-vinyl polymers include polyvinyl pyrrolidone polymers, co-polymers of N-vinylpyrrolidone and N-vinylimidazole, co-polymers of N-vinylpyrrolidone and acrylic acid, and mixtures thereof. Suitable co-polymers of N-vinylpyrrolidone and N-vinylimidazole are commercially available from BASF, under the trade name of Sokalan PG55. Suitable vinylpyrrolidone homopolymers, are commercially available from BASF under the trade names LUVISKOL K15 (viscosity molecular weight of 10,000), LUVISKOL K25 (viscosity molecular weight of 24,000), LUVISKOL K30 (viscosity molecular weight of 40,000), and other vinyl pyrrolidone homopolymers known to persons skilled in the detergent field (see for example EP-A-262,897 and EP-A-256,696). Suitable co-polymers of N-vinylpyrrolidone and acrylic acid are commercially available from BASF under the trade name SOKALAN PG 310. Preferred N-vinyl polymers are polyvinyl pyrrolidone polymers, co-polymers of N-vinylpyrrolidone and N-vinylimidazole, co-polymers of N-vinylpyrrolidone and acrylic acid, and mixtures thereof, even more preferred are polyvinyl pyrrolidone polymers.

Suitable anti-resoiling polymers also include soil suspending polycarboxylate polymers. Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenernalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in EP Application No. 66915. Particularly preferred is a copolymer of maleic/acrylic acid with an average molecular weight of 70,000. Such copolymers are commercially available from BASF under the trade name SOKALAN CP5.

Other suitable anti-resoiling polymers include those anti-resoiling polymers having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) C3 oxyalkylene terephthalate segments, wherein, if said hydrophobe components also comprise oxyethylene terephthalate, the ratio of oxyethylene terephthalate: C3 oxyalkylene terephthalate units is about 2:1 or lower, 00 C4-C6 alkylene or oxy C4-C6 alkylene segments, or mixtures therein, (iii) poly (vinyl ester) segments, preferably polyvinyl acetate), having a degree of polymerization of at least 2, or (v) C1-C4 alkyl ether or C4 hydroxyalkyl ether substituents, or mixtures therein, wherein said substituents are present in the form of C1-C4 alkyl ether or C4 hydroxyalkyl ether cellulose derivatives, or mixtures therein, and such cellulose derivatives are amphiphilic, whereby they have a sufficient level of C1-C4 alkyl ether and/or C4 hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a) (i) will have a degree of polymerization of from about 1 to about 200, although higher levels can be used, preferably from 3 to about 150, more preferably from 6 to about 100. Suitable oxy C4-C6 alkylene hydrophobe segments include, but are not limited to, end-caps of polymeric soil release agents such as MO3S(CH2)nOCH2CH2O—, where M is sodium and n is an integer from 4-6, as disclosed in U.S. Pat. No. 4,721,580.

Anti-resoiling polymers also include cellulosic derivatives such as hydroxyether cellulosic polymers, co-polymeric blocks of ethylene terephthalate or propylene terephthalate with polyethylene oxide or polypropylene oxide terephthalate, and the like. Such anti-resoiling polymers are commercially available and include hydroxyethers of cellulose such as METHOCEL (Dow). Cellulosic anti-resoiling polymers for use herein also include those selected from the group consisting of C1-C4 alkyl and C4 hydroxyalkyl cellulose; see U.S. Pat. No. 4,000,093. Anti-resoiling polymers characterised by poly(vinyl ester)hydrophobe segments include graft co-polymers of poly(vinyl ester), e.g., C1-C6 vinyl esters, preferably poly(vinyl acetate) grafted onto polyalkylene oxide backbones, such as polyethylene oxide backbones.

See EP Application 0 219 048. Commercially available anti-resoiling polymers of this kind include the SOKALAN type of material, e.g., SOKALAN HP-220, available from BASF.

One type of preferred anti-resoiling polymers is a co-polymer having random blocks of ethylene terephthalate and polyethylene oxide (PEO) terephthalate. The molecular weight of this anti-resoiling polymers is in the range of from about 25,000 to about 55,000. See U.S. Pat. No. 3,959,230 and U.S. Pat. No. 3,893,929.

Another preferred anti-resoiling polymers is a polyester with repeat units of ethylene terephthalate units which contains 10 15% of ethylene terephthalate units together with 90 80% of polyoxyethylene terephthalate units, derived from a polyoxyethylene glycol of average molecular weight 300-5, 000. Examples of this polymer include the commercially available material ZELCON 51260 (from Dupont) and MILEASE T (from ICI). See also U.S. Pat. No. 4,702,857.

Another preferred anti-resoiling polymers agent is a sulfonated product of a substantially linear ester oligomer comprised of an oligomeric ester backbone of terephthaloyl and oxyalkyleneoxy repeat units and terminal moieties covalently attached to the backbone. These anti-resoiling polymers are fully described in U.S. Pat. No. 4,968,451. Other suitable anti-resoiling polymers include the terephthalate polyesters of U.S. Pat. No. 4,711,730, the anionic end-capped oligomeric esters of U.S. Pat. No. 4,721,580, and the block polyester oligomeric compounds of U.S. Pat. No. 4,702,857.

Preferred anti-resoiling polymers also include the soil release agents that are disclosed in U.S. Pat. No. 4,877,896, which discloses anionic, especially sulfoaroyl, end-capped terephthalate esters.

Still another preferred anti-resoiling agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred anti-resoiling agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said anti-resoiling agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807.

The cleaning composition may include a builder detergent which increase the effectiveness of the surfactant. The builder detergent can also function as a softener and/or a sequestering and buffering agent in the cleaning composition. When employed, the builder detergent comprises at least about 0.001% and typically about 0.015% of the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri(hydroxymethyl) amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's Emulsifiers and Detergents, North American Edition, 1997, McCutcheon Division, MC Publishing Company Kirk and WO 95/07971.

The wipe or cleaning pad can be used for cleaning, disinfectancy, or sanitization on inanimate, household surfaces, including floors, counter tops, furniture, windows, walls, and automobiles. Other surfaces include stainless steel, chrome, and shower enclosures. The wipe or cleaning pad can be packaged individually or together in canisters, tubs, etc. The package may contain information printed on said package comprising a instruction to use the more abrasive side to remove soil followed by using the less abrasive side to wipe the soil away. The wipe or cleaning pad can be used with the hand, or as part of a cleaning implement attached to a tool or motorized tool, such as one having a handle. Examples of tools using a wipe or pad include U.S. Pat. No. 6,611,986; WO 00/71012; U.S. Pat. App. 2002/0129835; U.S. Pat. No. 6,192,543; WO00/71012; and WO00/27271.

Another embodiment of the instant invention is a method of incorporation of a cleaning composition into a single layer absorbent material producing a premoistened cleaning disposable substrate that comprises the steps of:

a) obtaining a single layered absorbent material; and
b) incorporating therein a cleaning composition, said composition comprising:
  i) from about 0.001% to about 2% by weight of linear, nonionic polyacrylamide;
  ii) from about 0.25% to about 15% by weight of a non-volatile organic solvent;
  iii) from about 0.001% to about 15% by weight of at least one detersive surfactant;
  iv) optionally from about 0% to about 5% by weight of other cleaning polymers and
  v) balance water.

Another embodiment of the instant invention is a method of removing dirt and debris from a hard or soft surface that comprises the steps of:

A. providing a premoistened cleaning disposable substrate said substrate comprising:
a) a single layered absorbent material; and
b) a cleaning composition, said composition comprising:
  i) from about 0.001% to about 2% by weight of polyacrylamide;
  ii) from about 0.25% to about 15% by weight of a non-volatile organic solvent;
  iii) from about 0.001% to about 15% by weight of at least one detersive surfactant;
  iv) optionally from about 0% to about 5% by weight of other cleaning polymers; and
  v) balance water; and B. engaging the dirt and debris laden dry hard or soft surface with a surface of the premoistened cleaning disposable substrate with sufficient force to remove dirt from the dirt laden hard or soft surface whereby dirt is prevented from being redeposited onto said hard or soft surface once the dirt is removed therefrom.

It is understood that the hard or soft surface described herein is not the human body.

The following examples describe certain embodiments of this invention, but the invention is not limited thereto. It should be understood that numerous changes to the disclosed embodiments could be made in accordance with the disclosure herein without departing from the spirit or scope of the invention. These examples are therefore not meant to limit the scope of the invention. Rather, the scope of the invention is to be determined only by the appended claims and their equivalents. In these examples, all parts given are by weight unless otherwise indicated. The abbreviation "®" stands for Registered Trade Mark.

Preparation of Test Soil Mixture

AATCC carpet soil (1 g, TM-122, Textile Innovators, Windsor, N.C. USA) and black charm research clay (3 g, Textile Innovators, Windsor, N.C. USA) are mixed together in a beaker. Deionized water (15 g) is added to the soil mixture and agitated while heating to 75 C. Once the mixture is at 75 C, aqueous sugar solution (4 g, 50 wt %), melted vegetable shortening (Crisco®, 1 g), isopropanol (120 g) and vegetable oil (Crisco®, 1 g) are added. The soil mixture is kept at 75 C for one hour after which it is cooled to ambient temperature and added to a spraying apparatus.

White Ceramic Tile Treatment Procedure:

White ceramic tiles are pre-cleaned. The CIE Lab and gloss value of each tile is measured. The sprayer containing the soil mixture is held approximately 30 cm from the tile to be treated. The tile is sprayed with approximately 20 (1 second) bursts toward the tile to build a base. Spraying is stopped for 2 minutes between every 10 bursts to allow drying and prevent running. This is continued until the desired coating level is reached. The tile is allowed to sit and dry at room temperature overnight. The tile is baked at 105° C. for 4 hours. The tile is allowed to cool. The CIE Lab and gloss value of each tile is measured. The soiled tiles are placed on a Gardener Scrub Instrument. The cellulose sponges are wrapped with plastic wrap and placed in the holder. The treated premoistened substrate of the instant invention or a commercially available wipe is placed around the sponge in the holder. The Gardner machine is set for four cycles. The sponge passes over the soiled tiles for four cycles. The CIE Lab and gloss value of each tile is measured at the end of the fourth cycle.

Black Enamel Panel Treatment Procedure:

Black enamel panels (12×18 inch) are pre-cleaned. The CIE gloss value of each panel is measured. Black charm research clay (0.5 g per panel) is sprinkled on the entire surface of each panel. The treated panel is sprayed with water and wet soil is spread evenly over the panel. Each test panel is allowed to dry. The treated premoistened substrate of the instant invention or a commercially available wipe is passed over the soiled panels four times. The CIE gloss value of each cleaned panel is measured at the end of the fourth pass.

Measurement of Tiles and Panels:

CIE Lab measurements on the ceramic surfaces are measured at the start, after soil treatment, and after cleaning with the wipe of the instant invention or a commercially available wipe in three locations on each tile with three tiles per test wipe formulation. Measurements are made on a Minolta CM-2600d with D65 illuminant and 10° observer. Gloss values were determined at 8 degrees using SCE (Specular Excluded) and SCI (Specular Included).

Soil removal and gloss retention are determined using the following equations:

$$\text{Soil Removal (\%)}=((\text{delta } E_d-\text{delta } E_f)/\text{delta } E_f)*100$$

$$\text{delta } E_d=[(L_d-L_c)^2+(a_d-a_c)^2+(b_d-b_c)^2]^{1/2}$$

$$\text{delta } E_f=[(L_f-L_c)^2+(a_f-a_c)^2+(b_f-b_c)^2]^{1/2}$$

(c: clean tile; d: soiled tile; f: final after cleaning with wipe)

$$\text{Gloss Retention (\%)}=(100-(Ig-Fg/Ig))*100$$

(I: initial reading, F: final reading and g: gloss)

Example 1

Cleaning Formulation with Alkylpolyglucoside Component

Formulation A. Alkylpolyglucoside Formula

| Ingredient | Supplier &/or Trade Name | A | $A_1$ |
|---|---|---|---|
| Alkylpolyglucoside | Glucopon 425N | 0.03 | 0.03 |
| 1-butoxy-2-propanol | Aldrich | 1 | 1 |
| Polymer 1 | Ciba | 0 | 0.02 |
| Preservative | Kathon CG/ICP | 0.0002 | 0.0002 |
| Water to | Deionized | 100 | 100 |
| pH | | 7.29 | 5.55 |
| Loading on wipe | | 325% | 370% |

Polymer 1 is polyacrylamide, molecular weight = 10,000,000 to 15,000,000, linear and non-cross linked; wipe is a polyester/wood pulp non-woven type.

The formulation is carried out on a 100 gram scale. To a beaker equipped with a magnetic stirrer is added deionized water (90 g). Polymer 1 (0.02 g) is added and mixed until it is fully dissolved. At this point, Polymer 1 is fully swollen. The alkylpolyglucoside (0.03 g) is added and mixed until fully dissolved. The 1-butoxy-2-propanol (1 g) is added and mixed until fully dissolved. The preservative (0.0002 g) is added and mixed until fully dissolved. Enough deionized water is added to bring the total formulation weight 100 grams.

Example 2

Cleaning Formulation with Quaternary Ammonium Biocide Component

Formulation B. Quaternary Ammonium Biocide Formula

| Ingredient | Supplier &/or Trade Name | B | $B_1$ |
|---|---|---|---|
| Quaternary biocide | Barquat 4250 | 0.15 | 0.15 |
| EDTA | Versene 100 | 0.11 | 0.11 |
| 1-butoxy-2-propanol | Aldrich | 1.5 | 1.5 |
| Amine oxide surfactant | Ammonyx LO | 0.12 | 0.12 |
| Nonionic surfactant | Surfonic L24-9 | 0.4 | 0.4 |
| Isopropyl alcohol | Aldrich | 1 | 1 |

-continued

Formulation B. Quaternary Ammonium Biocide Formula

| Ingredient | Supplier &/or Trade Name | B | $B_1$ |
|---|---|---|---|
| Potassium Citrate | Aldrich | 0.1 | 0.1 |
| Polymer 1 | Ciba | | 0.02 |
| Water to | Deionized | 100 | 100 |
| pH | | 11.35 | 11.31 |
| Loading on wipe | | 300% | 272% |

Polymer 1 is polyacrylamide, molecular weight = 10,000,000 to 15,000,000, linear and non-cross linked; wipe is a polyester/wood pulp non-woven type.

The formulation is carried out on a 100 gram scale. To a beaker equipped with a magnetic stirrer is added deionized water (90 g). Polymer 1 (0.02 g) is added and mixed until it is fully dissolved. At this point, Polymer 1 is fully swollen. The Quaternary biocide (0.15 g) is added and mixed until fully dissolved. The EDTA (0.11 g) is added and mixed until fully dissolved. The 1-butoxy-2-propanol (1.5 g) is added and mixed until fully dissolved. The Amine oxide surfactant (0.12 g) is added and mixed until fully dissolved. The nonionic surfactant (0.40 g) is added and mixed until fully dissolved. The isopropyl alcohol (1 g) is added and mixed until fully dissolved. The potassium citrate (0.1 g) is added and mixed until fully dissolved. Enough deionized water is added to bring the total formulation weight 100 grams.

Example 3

Cleaning Formulation with Quaternary Ammonium Biocide Component

Formulation C. Quaternary Ammonium Biocide Formula

| Ingredient | Supplier &/or Trade Name | C | $C_1$ |
|---|---|---|---|
| Quaternary biocide | Barquat 4250 | 0.15 | 0.15 |
| EDTA | Versene 100 | 0.038 | 0.038 |
| 1-butoxy-2-propanol | Lab | 1.5 | 1.5 |
| Amine oxide | Ammonyx LO | 0.075 | 0.075 |
| Nonionic | Surfonic L24-9 | 0.25 | 0.25 |
| Isopropyl alcohol | Aldrich | 2 | 2 |
| Ammonium Chloride | Aldrich | 0.1 | 0.1 |
| Polymer 1 | Ciba | | 0.02 |
| Water to | Deionized | 100 | 100 |
| pH | | 8.73 | 8.30 |
| Loading on wipe | | 254% | 290% |

Polymer 1 is polyacrylamide, molecular weight = 10,000,000 to 15,000,000, linear and non-cross linked; wipe is a polyester/wood pulp non-woven type.

The formulation is carried out on a 100 gram scale. To a beaker equipped with a magnetic stirrer is added deionized water (90 g). Polymer 1 (0.02 g) is added and mixed until it is fully dissolved. At this point, Polymer 1 is fully swollen. The Quaternary biocide (0.15 g) is added and mixed until fully dissolved. The EDTA (0.038 g) is added and mixed until fully dissolved. The 1-butoxy-2-propanol (1.5 g) is added and mixed until fully dissolved. The Amine oxide surfactant (0.075 g) is added and mixed until fully dissolved. The nonionic surfactant (0.25 g) is added and mixed until fully dissolved. The isopropyl alcohol (2 g) is added and mixed until fully dissolved. The ammonium chloride (0.1 g) is added and mixed until fully dissolved. Enough deionized water is added to bring the total formulation weight 100 grams.

Example 4

Cleaning Formulation with Dodecylbenzene Sulfonate Sodium Salt Component

Formulation D. Dodecylbenzene Sulfonate Sodium Salt Formula

| Ingredient | Supplier &/or Trade Name | D | $D_1$ |
|---|---|---|---|
| Dodecylbenzene sulfonate Sodium Salt | Calsoft LAS-40 | 0.6 | 0.6 |
| 2-butoxyethanol | Aldrich | 2 | 2 |
| Polymer 1 | Ciba | | 0.025 |
| Tetrapotassium pyrophosphate (TKPP) | Aldrich | 2 | 2 |
| Ethanol | Aldrich | 2 | 2 |
| Water to | Deionized | 100 | 100 |
| pH | | 11 | 11 |
| Loading on wipe | | 300% | 300% |

Polymer 1 is polyacrylamide, molecular weight = 10,000,000 to 15,000,000 Daltons, linear and non-cross linked; wipe is a polyester/wood pulp non-woven type.

The formulation is carried out on a 100 gram scale. To a beaker equipped with an overhead stirrer is added deionized water (90 g). The solid builder (TKPP, 2 g) is added and mixed until fully dissolved. Polymer 1 (0.025 g) is added and mixed until it is fully dissolved. At this point, Polymer 1 is fully swollen. The surfactant (0.60 g) is added and mixed until fully dissolved. The 1-butoxy-2-propanol (2 g) is added and mixed until fully dissolved. The ethanol (2 g) is added and mixed until fully dissolved. Enough deionized water is added to bring the total formulation weight 100 grams.

Example 5

Preparation and Testing of Premoistened Cleaning Wipe Using Alkylpolyglucoside Formulation The formulation of Instant Example 1 is applied to a polyester/wood pulp, non-woven, dry towelette or wipe using a padding machine. The percentage weight up take is noted and is based of the dry weight of the towelette or wipe. The premoistened cleaning wipe of the instant invention is used to clean soiled white ceramic tile as per the aforementioned procedure.

| Wipe containing Formulation | Formulation Uptake (weight percent) | Soil Removal (%) |
|---|---|---|
| Clorox.RTM* | NA | 28 |
| A | 325 | 44 |
| A1 | 370 | 89 |

*Clorox.RTM Disinfectant Wipes

These data demonstrate that the premoistened disposable cleaning substrates of the instant invention are used to clean surfaces with outstanding results.

Example 6

Preparation and Testing of Premoistened Cleaning Wipe Using Alkylpolyglucoside Formulation The formulation of Instant Example 1 is applied to a polyester/wood pulp, non-woven, dry towelette using a padding machine. The percentage weight up take is noted and is based of the dry weight of the towelette or wipe. The premoistened cleaning wipe of the instant invention is used to clean soiled black enamel panels as per the aforementioned procedure.

| Wipe containing Formulation | Formulation Uptake (weight percent) | Gloss Retention (%) |
|---|---|---|
| Clorox.RTM* | NA | 47 |
| A | 325 | 26 |
| A1 | 370 | 94 |

*Clorox.RTM Disinfectant Wipes

These data demonstrate that the premoistened disposable cleaning substrates of the instant invention are used to clean surfaces with outstanding results.

Example 7

Preparation and Testing of Premoistened Cleaning Wipe Using Quaternary Ammonium Biocide Formulation The formulation of Instant Example 2 is applied to a polyester/wood pulp, non-woven, dry towelette using a padding machine. The percentage weight up take is noted and is based of the dry weight of the towelette or wipe. The premoistened cleaning wipe of the instant invention is used to clean soiled black enamel panels as per the aforementioned procedure.

| Wipe containing Formulation | Formulation Uptake (weight percent) | Gloss Retention (%) |
|---|---|---|
| Lysol.RTM** | NA | <50 |
| B | 300 | 57 |
| B1 | 272 | 87 |

**Lysol.RTM Sanitizing Wipes

These data demonstrate that the premoistened disposable cleaning substrates of the instant invention are used to clean surfaces with outstanding results.

Example 8

Preparation and Testing of Premoistened Cleaning Wipe Using Dodecylbenzene Sulfonate Sodium Salt Formulation The formulation of Instant Example 4 is applied to a polyester/wood pulp, non-woven, dry towelette using a padding machine. The percentage weight up take is noted and is based of the dry weight of the towelette. The premoistened cleaning wipe of the instant invention is used to clean soiled black enamel panels as per the aforementioned procedure.

| Wipe containing Formulation | Formulation Uptake (weight percent) | Gloss Retention (%) |
|---|---|---|
| Lysol.RTM** | NA | <50 |
| D | 300 | 40 |
| D1 | 300 | 96 |

**Lysol.RTM Sanitizing Wipes

These data demonstrate that the premoistened disposable cleaning substrates of the instant invention are used to clean surfaces with outstanding results.

Example 9

Preparation and Testing of Premoistened Cleaning Wipe Using Formulations Listed in U.S. Pat. No. 4,820,450

The cleaning compositions listed in U.S. Pat. No. 4,820,450 Examples 1-20 are formulated to include 0.1 weight percent of Polymer 1 of the instant invention. These cleaning formulations are applied to a polyester/wood pulp, non-woven, dry towelette using methods known to those skilled in the art. The percentage weight up take is noted and is based of the dry weight of the towelette or wipe. The premoistened cleaning wipe or substrate of the instant invention is thus obtained. These premoistened disposable cleaning substrates are used clean a variety of hard and soft surfaces with outstanding results.

Example 10

Preparation and Testing of Premoistened Cleaning Wipe Using Formulations Listed in U.S. Pat. No. 6,251,849

The cleaning compositions listed in U.S. Pat. No. 6,251,849 Tables 1 and 4-7 are formulated to include 0.1 weight percent of Polymer 1 of the instant invention. These cleaning formulations are applied to a polyester/wood pulp, non-woven, dry towelette or wipe using methods known to those skilled in the art. The percentage weight up take is noted and is based of the dry weight of the towelette or wipe. The premoistened cleaning wipe or substrate of the instant invention is thus obtained. These premoistened disposable cleaning substrates are used clean a variety of hard and soft surfaces with outstanding results.

Example 11

Preparation and Testing of Premoistened Cleaning Wipe Using Formulations Listed in U.S. Pat. No. 6,653,274

The cleaning compositions listed in U.S. Pat. No. 6,653,274 Examples 1 and 3 are formulated to include 0.1 weight percent of Polymer 1 of the instant invention. These cleaning formulations are applied to a polyester/wood pulp, non-woven, dry towelette or wipe using methods known to those skilled in the art. The percentage weight up take is noted and is based of the dry weight of the towelette or wipe. The premoistened cleaning wipe or substrate of the instant invention is thus obtained. These premoistened disposable cleaning substrates are used clean a variety of hard and soft surfaces with outstanding results.

Example 12

Preparation and Testing of Premoistened Cleaning Wipe Using Formulations Listed in US 2005/0192199

The cleaning compositions listed in US 2005/0192199 Tables 1-4 and 6 are formulated to include 0.1 weight percent of Polymer 1 of the instant invention. These cleaning formulations are applied to a polyester/wood pulp, non-woven, dry towelette or wipe using methods known to those skilled in the art. The percentage weight up take is noted and is based of the dry weight of the towelette or wipe. The premoistened cleaning wipe or substrate of the instant invention is thus obtained. These premoistened disposable cleaning substrates are used clean a variety of hard and soft surfaces with outstanding results.

What is claimed is:

1. A premoistened cleaning disposable substrate for cleaning hard or soft surfaces, said substrate comprising:
- a) a single layered substrate; and
- b) a cleaning composition, said composition comprising:
  - i) from about 0.001% to about 5% by weight of linear, nonionic homopolymer of acrylamide having a weight average molecular weight from about 10,000,000 to about 15,000,000 Daltons;
  - ii) from about 0.25% to about 15% by weight of a non-volatile organic solvent;
  - iii) from about 0.001% to about 15% by weight of at least one detersive surfactant;
  - iv) optionally from about 0.001% to about 5% by weight of other cleaning polymers; and
  - v) balance water, wherein the hard or soft surface is not the human body.

2. A premoistened cleaning disposable substrate according to claim 1 wherein said polyacrylamide of component (b) i) is present in the cleaning composition in a concentration from about 0.001 percent to about 2 percent by weight based on the weight of the composition.

3. A premoistened cleaning disposable substrate according to claim 2 wherein said polyacrylamide of component (b) i) is present in the cleaning composition in a concentration from about 0.001 percent to about 0.5 percent by weight based on the weight of the composition.

4. A premoistened cleaning disposable substrate according to claim 1 wherein said cleaning composition of component (b) is present in said substrate of component (a) in a concentration from about 50 percent to about 1000 percent by weight relative to the weight of the dry substrate.

5. A premoistened cleaning disposable substrate according to claim 4 wherein said cleaning composition of component (b) is present in said substrate of component (a) in a concentration from about 200 percent to about 800 percent by weight relative to the weight of the dry substrate.

6. A premoistened cleaning disposable substrate according to claim 5 wherein said cleaning composition of component (b) is present in said substrate of component (a) in a concentration from about 200 percent to about 500 percent by weight relative to the weight of the dry substrate.

7. A premoistened cleaning disposable substrate according to claim 1 wherein said substrate is a cleaning wipe.

8. A premoistened cleaning disposable substrate according to claim 1 wherein said substrate is a cleaning pad attached to a cleaning implement.

9. A method of removing dirt and debris from a hard or soft surface that comprises the steps of:
- A. providing a premoistened cleaning disposable substrate said substrate comprising:
  - a) obtaining a single layered absorbent material; and
  - b) a cleaning composition, said composition comprising:
    - i) from about 0.001% to about 5% by weight of linear, nonionic homopolymer of acrylamide having a weight average molecular weight from about 10,000,000 to about 15,000,000 Daltons;

ii) from about 0.25% to about 15% by weight of a non-volatile organic solvent;

iii) from about 0.001% to about 15% by weight of at least one detersive surfactant;

iv) optionally from about 0% to about 5% by weight of other cleaning polymers and v) balance water; and B. engaging the dirt and debris laden dry hard or soft surface with a surface of the premoistened cleaning disposable substrate with sufficient force to remove dirt from the dirt laden hard or soft surface whereby dirt is prevented from being redeposited onto said hard or soft surface once the dirt is removed therefrom, wherein the hard or soft surface is not the human body.

10. A method according to claim 9 wherein said polyacrylamide of component (b) i) is present in the cleaning composition in a concentration from about 0.001 percent to about 2 percent by weight based on the weight of the composition.

11. A method according to claim 10 wherein said polyacrylamide of component (b) i) is present in the cleaning composition in a concentration from about 0.001 percent to about 0.5 percent by weight based on the weight of the composition.

12. A method according to claim 9 wherein said cleaning composition of component (b) is present in said substrate of component (a) in a concentration from about 50 percent to about 1000 percent by weight relative to the weight of the dry substrate.

13. A method according to claim 12 wherein said cleaning composition of component (b) is present in said substrate of component (a) in a concentration from about 200 percent to about 800 percent by weight relative to the weight of the dry substrate.

14. A method according to claim 13 wherein said cleaning composition of component (b) is present in said substrate of component (a) in a concentration from about 200 percent to about 500 percent by weight relative to the weight of the dry substrate.

15. A method according to claim 9 wherein said substrate is a cleaning wipe.

16. A method according to claim 9 wherein said substrate is a cleaning pad attached to a cleaning implement.

* * * * *